US005144713A

United States Patent [19]

Unger

[11] Patent Number: 5,144,713

[45] Date of Patent: Sep. 8, 1992

[54] HAND-OPERATED WIPING INSTRUMENT FOR FLOORS

[75] Inventor: Henry M. Unger, Weston, Conn.

[73] Assignee: Unger Licensing Limited, Weston, Conn.

[21] Appl. No.: 674,659

[22] Filed: Mar. 25, 1991

[30] Foreign Application Priority Data

Mar. 30, 1990 [DE] Fed. Rep. of Germany ..... 4010197

[51] Int. Cl.[5] ..... A47L 13/11

[52] U.S. Cl. ..... 15/245; 15/144.4

[58] Field of Search ..... 15/245, 143 R, 143 A, 15/144 B

[56] References Cited

U.S. PATENT DOCUMENTS 2,746,072 5/1956 Lumpkin ..... 15/245 X
3,063,082 11/1962 Rosenberg ..... 15/401 X

FOREIGN PATENT DOCUMENTS 6930712 8/1969 Fed. Rep. of Germany .
591255 1/1927 France .
547286 8/1942 United Kingdom ..... 15/245
2020546 11/1979 United Kingdom .

*Primary Examiner*—Chris K. Moore

[57] ABSTRACT

The invention relates to a hand-operated wiping instrument for floors. The wiping instrument comprises a frame 1 with support and guide rollers 5, arranged at the front in the direction of movement F, and a wiping strip 7 arranged after said support and guide rollers in the direction of movement. The frame 1 supports a guide pole 3 with a handle 4 which is located in a plane A perpendicular to the direction of movement F, the distance a of which plane from the wiping strip 7 is substantially smaller than the distance b of the wiping strip 7 from the support and guide element 5. A wiping instrument of this type can be easily handled with a good wiping effect because the wiping strip is dragged and not pushed.

8 Claims, 2 Drawing Sheets

HAND-OPERATED WIPING INSTRUMENT FOR FLOORS

Figure 1:
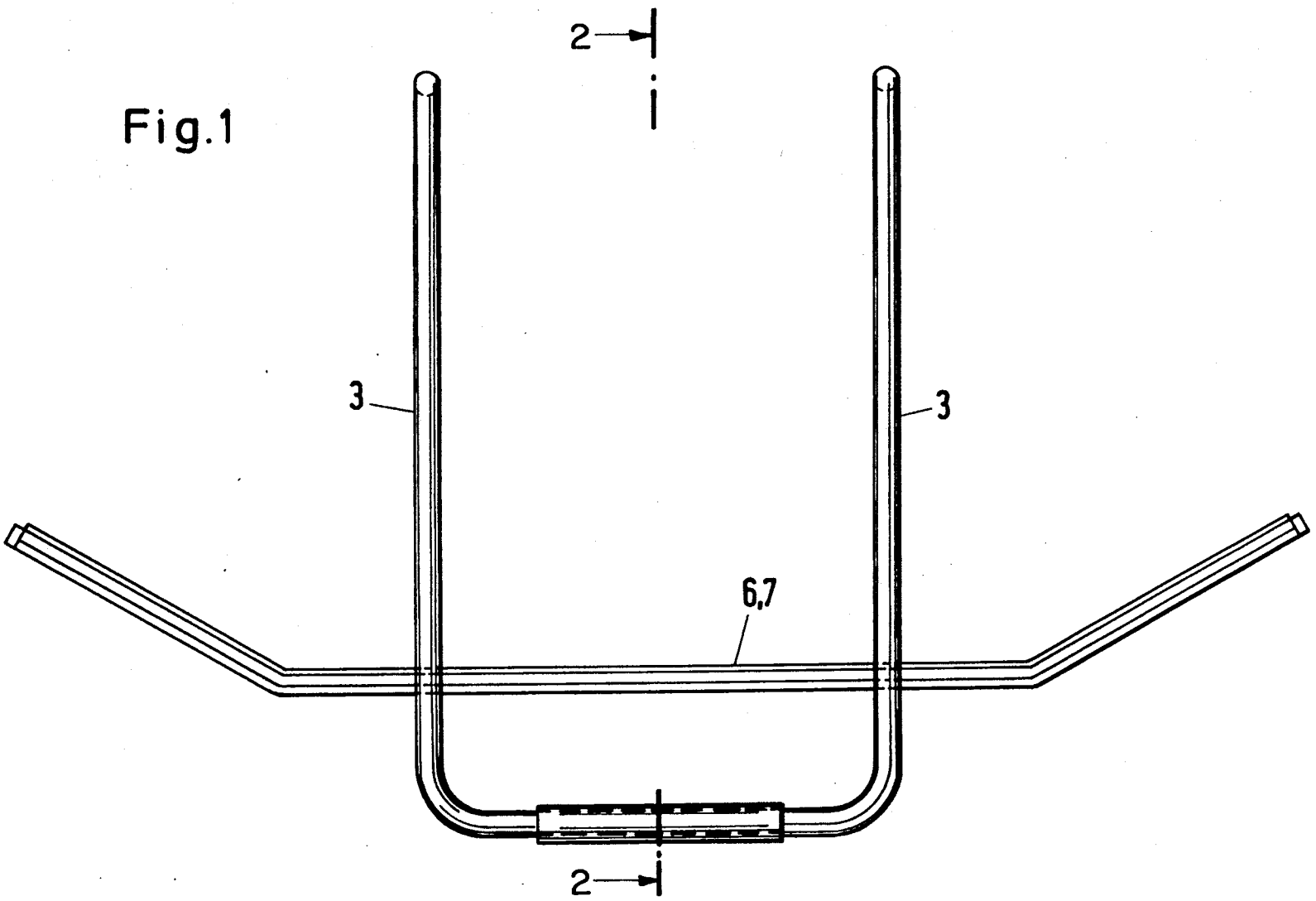

The invention relates to a hand-operated wiping instrument for floors, comprising a frame with a guide pole having a handle at operating level and with at least one support and guide element arranged at the front in the direction of movement and a wiping strip supported by the frame and arranged transversely to the direction of movement and after the support and guide element.

In a known wiping instrument of this type, the frame has a length in the direction of movement of about 20 cm and the wiping strip has a length of about 1 m. Arranged spaced apart at the front edge of the frame in the direction of movement are two steering rollers as support and guide elements. The guide pole extends at an angle of about 45° from the centre of the frame. The handle of the pole is located on the side of the strip facing away from the guide rollers in a plane perpendicular to the direction of movement, the distance of which plane from the wiping strip is many times greater than the distance of the wiping strip from the guide rollers. It has been shown in practice that the handling of such a wiping instrument is not easy. If insufficient pressure is applied to the wiping strip via the guide pole, the result of wiping is not satisfactory. If too much pressure is applied to the wiping strip, the instrument cannot easily be guided.

The underlying object of the invention is to simplify the wiping instrument of the type mentioned at the beginning in respect of its handling.

This object is achieved in the wiping instrument of the type mentioned at the beginning in that the distance of the wiping strip from the support and guide element is substantially greater than its distance from the plane located perpendicular to the direction of movement, in which plane the handle is located.

In the wiping instrument according to the invention, the introduction of the force applied by the operator into the wiping instrument is not critical because, due to the geometric arrangement of the handle, the wiping strip and the support and guide element relative to one another, there is more a dragging effect on the wiping strip than a pushing effect as is the case in the prior art. For this reason, the wiping instrument can be guided more precisely and a more even wiping effect can be achieved.

According to a preferred embodiment of the invention, the wiping strip is located between the support and guide element and the plane located perpendicular to the direction of movement, in which plane the handle is located. For individual adaptation to the floor conditions and to the operator, provision is made according to a further embodiment of the invention for the frame to be adjustable, in particular telescopic, in its distance between the support and guide element and the wiping strip.

The support and guide element should be constructed as a roller, as is known per se. The roller should be freely steerable. Provision should preferably be made for two support and guide elements to be arranged spaced apart.

In order to collect the water during wiping, the wiping strip can have slightly angled-off ends in the direction of movement or can be slightly bent.

The invention is explained in greater detail below with reference to a drawing illustrating an exemplary embodiment.

Figure 2:
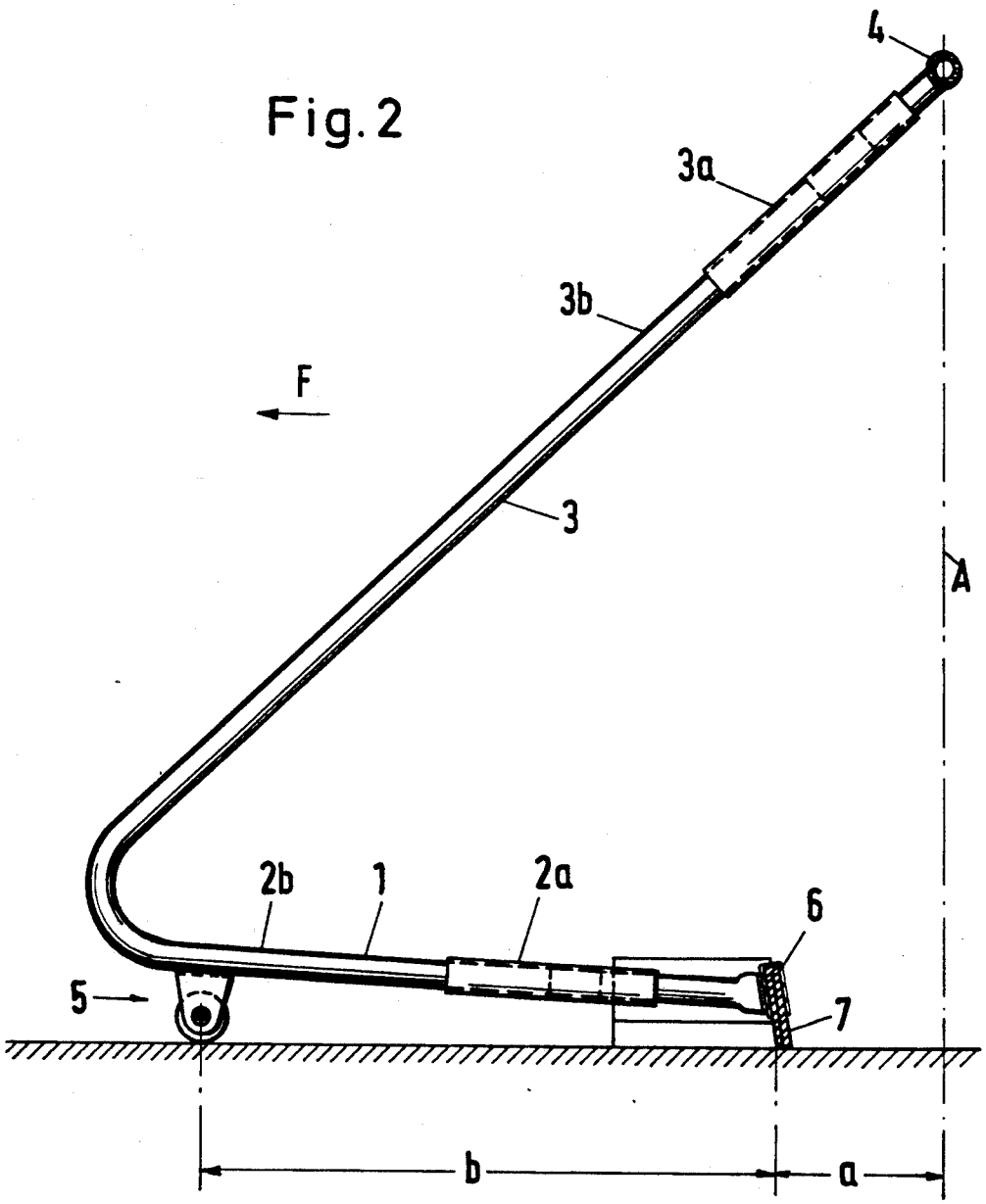

FIG. 1 shows a plan view of a wiping instrument and FIG. 2 shows the wiping instrument in accordance with FIG. 1 in a section along the line I—I of FIG. 1.

The wiping instrument illustrated in the drawing in a lateral view has a frame 1 comprising two telescopic tubes *2a*, *2b* arranged spaced apart. Connected to the frame 1 at the front in the direction of movement is a guide pole 3 with a handle 4 arranged at the operating level of the operator. Arranged on the frame 1 in the region of this connection point are support and guide elements 5 constructed as freely steerable rollers. At its rear end in the direction of travel F, the frame 1 supports a wiping strip 7, made of a foamed rubber profile, by means of a holder 6. The ends of the wiping strip 7 are slightly angled off towards the front so that the water collected during wiping does not drain off laterally.

As can be seen from the drawing, the handle 4 is located in a plane A perpendicular to the direction of movement F, the distance a of which plane from the wiping strip 7 is substantially smaller than the distance b of the support and guide element 5 from the wiping strip 7. In particular, a = 10–20 cm and b = 50–60 cm. Taking the telescopic frame 1 into consideration, the distance b should be at least twice as large as the distance a. Due to the telescopic capability, the distance a could even be 0 or the wiping strip 7 could be located on the left side in the diagram of the plane A. It is guaranteed in all cases that the distance b is substantially greater than the distance a.

I claim:

1. A hand-operated wiping instrument for floors, comprising a frame, a guide pole extending from said frame, said guide pole including a handle located at an operating level of said wiping instrument, at least one support and guide element which supports said wiping instrument and guides it along a direction of movement, said support and guide element being arranged in a front location of said frame relative to the direction of movement, and a wiping strip arranged in said frame transversely to the direction of movement, said wiping strip being located in said frame at a position which is rearward of said support and guide element and which is separated from said support and guide element so that the closest distance between said wiping strip and said support and guide element is greater than the distance between said wiping strip and a plane which contains said handle and is perpendicular to the direction of movement.

2. The wiping instrument of claim 1 wherein said wiping instrument is located between said plane and said support and guide element.

3. The wiping instrument of claim 1 or 2 further comprising adjustment means for adjusting the distance between said wiping strip and said support and guide element.

4. The wiping instrument of claim 3 wherein said adjustment means comprises telescoping means in said frame.

5. The wiping instrument of claim 1 wherein said support and guide element comprises a roller.

6. The wiping instrument of claim 5 wherein said roller is freely steerable.

7. The wiping instrument of claim 1 wherein said support and guide element comprises a pair of spaced apart rolling units.

8. The wiping instrument of claim 1 wherein said wiping strip includes end portions which are set back at an angle to the direction of movement.

* * * * *